US005887677A

United States Patent [19]

Malmgren

[11] Patent Number: 5,887,677

[45] **Date of Patent: *Mar. 30, 1999**

[54] DEVICE AT POWER LINE POLES

[76] Inventor: Ulf Malmgren, Kaserngatan 141, Västerås, S-723 47, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 663,236

[22] PCT Filed: Nov. 23, 1994

[86] PCT No.: PCT/SE94/01117

§ 371 Date: Jun. 7, 1996

§ 102(e) Date: Jun. 7, 1996

[87] PCT Pub. No.: WO95/15790

PCT Pub. Date: Jun. 15, 1995

[30] Foreign Application Priority Data

Dec. 7, 1993 [SE] Sweden ..... 9304098-8

[51] Int. Cl.[6] ..... E06C 1/38

[52] U.S. Cl. ..... 182/92

[58] Field of Search ..... 182/90, 92, 8, 182/9

[56] References Cited

U.S. PATENT DOCUMENTS

| | | | |
|---|---|---|---|
| 359,394 | 3/1887 | Jones | 411/392 |
| 829,336 | 8/1906 | Haycock . | |
| 2,957,538 | 10/1960 | Pottmeyer . | |
| 3,712,418 | 1/1973 | Currence | 182/92 |
| 4,450,936 | 5/1984 | Strom | 182/92 |
| 4,932,497 | 6/1990 | Raso . | |

FOREIGN PATENT DOCUMENTS

| | | | |
|---|---|---|---|
| 396961 | 5/1993 | Austria . | |
| 43 12 087 | 10/1993 | Germany . | |
| 7479 | 4/1895 | United Kingdom | 182/90 |

*Primary Examiner*—Alvin Chin-Shue
*Attorney, Agent, or Firm*—Pollock, Vande Sande & Priddy

[57] ABSTRACT

A climbing device comprising a safety step having a bent section a pair of aligned straight sections on either side of the bent section.

4 Claims, 2 Drawing Sheets

DEVICE AT POWER LINE POLES

TECHNICAL FIELD

The present invention relates to an apparatus to enable climbing in a power-line pylon, for example, without the risk of falling, foot-rests being provided along said pylon.

BACKGROUND ART

According to official regulations safety arrangements shall be used when climbing in a power-line pylon, for instance when carrying out repairs or maintenance. Climbing is normally performed on foot-rests arranged along the power-line pylons. Climbing also occurs in the trusses in the power-line pylons. One method of providing protection against falling when climbing on foot-rests or trusses is to use a life-line. When climbing is started, a first end of the life-line is secured in a steel rope extending between the upper and lower part of the pylon, running over a block at the top of the pylon. The steel wire is used to pull the life-line over the block. The other end of the life-line is secured to a belt worn by the climber, after which climbing can commence with the life-line affording protection against falling.

The problem with climbing using the life-lines described above is that the steel rope arranged in the pylon is an expensive arrangement often disappears due to theft.

The object of the invention is to provide an arrangement that is simple to use, thereby enabling climbing without the risk of falling.

SUMMARY OF THE INVENTION

The invention aims at solving these and other associated problems. It is characterized in that the foot-rests comprise a safety foothold enabling climbing with a life-line. The life-line is inserted into or removed from the safety foothold with a simple one-hand action while climbing, the safety foothold have a bent part, the ends of which are connected to the foot-rest so that the parts of the foot-rest on each side of the bent part have coinciding central axes.

Such an arrangement is simple to manipulate since the line will run parallel to the attachment. Protection against falling during climbing is ensured by designing the safety foothold as an open loop to receive the life-line.

The foot-rest is shaped in known manner and consists of a rod with a first and a second end, each end being provided with an anti-slip device in the form of a flange. The protection against falling, or safety foothold, is between the flanges. The open loop in the safety foothold can be produced in many different ways, one of which is described below by way of example.

It is not necessary for every foot-rest position along the pylon to be provided with a device according to the invention. It may be suitable for every second or third foot-rest position to be provided with a device according to the invention, while the intermediate positions are provided with conventional foot-rests.

A further advantage of the invention is that the arrangement of foot-rests with safety footholds in power-line pylons, for instance, enables the climber to place the life-line in the safety foothold using only one hand while climbing up or down or laterally in either direction, and still be protected against falling.

BRIEF DESCRIPTION OF THE DRAWINGS

The invention is described in more detail by way of example in the accompanying drawings.

DETAILED DESCRIPTION OF THE PREFERRED EMBODIMENTS

Figure 1:
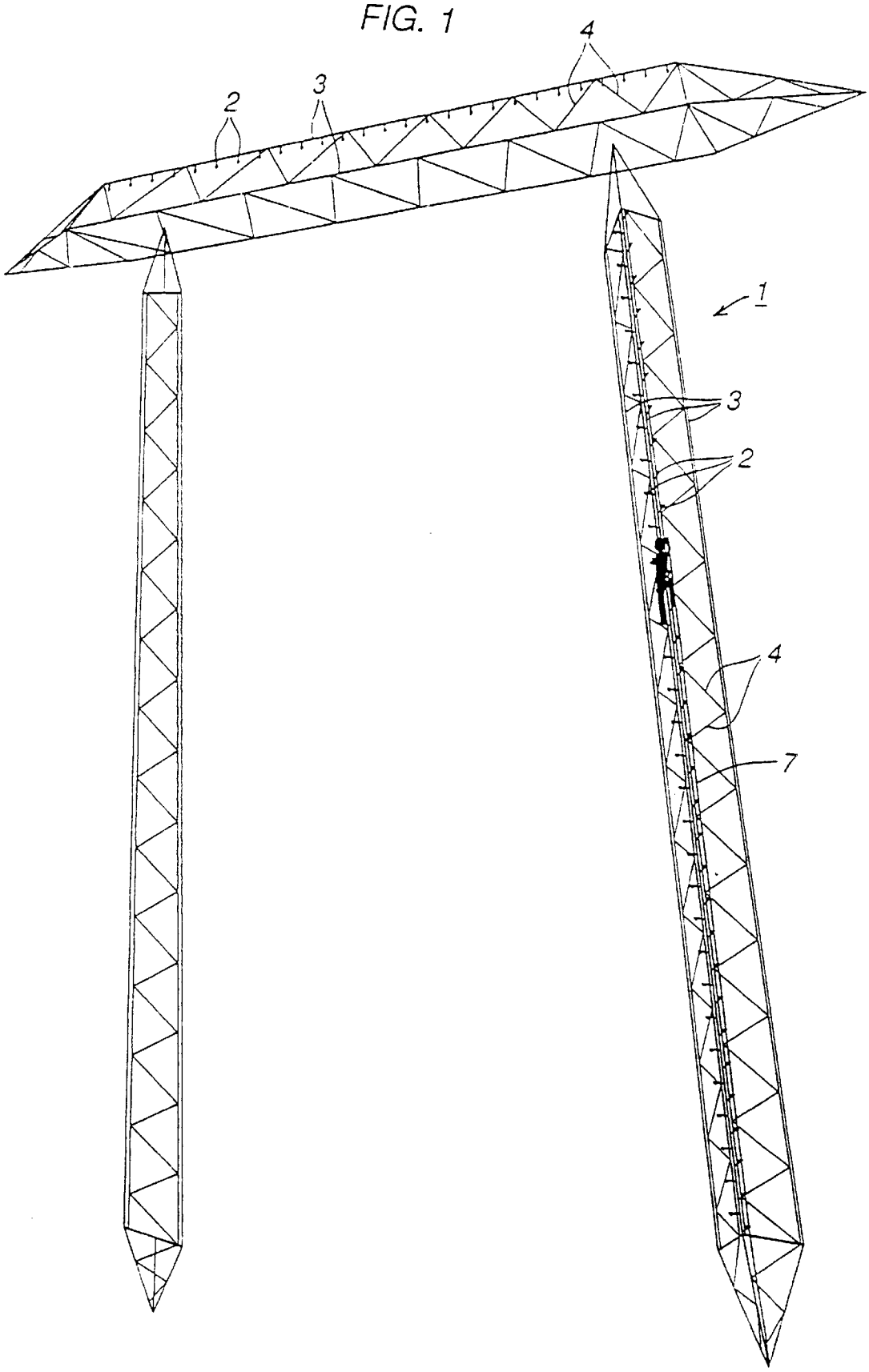
FIG. 1 shows schematically an example of a power-line pylon provided with an apparatus according to the invention.

FIG. 1 shows schematically an example of a power-line pylon 1 provided with a device 2 according to the invention, secured to several foot-rest positions along one of the frame posts 3 of the pylon 1. Diagonals 4 are arranged between the frame posts. The pylon 1 shown in the drawings is made of steel but the device can of course be used on pylons of concrete or other materials.

Figure 2:
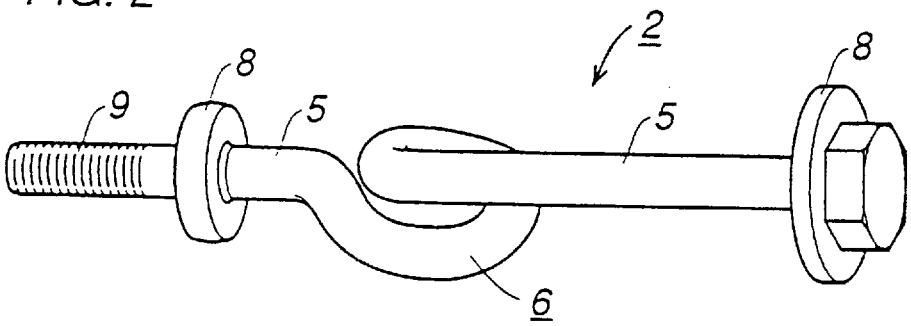
FIG. 2 shows an embodiment of the apparatus according to the invention.

Foot-rests 5 including a safety foothold 6 are arranged in at least some of the foot-rest positions, see FIG. 2, to permit climbing with a life-line 7 that is inserted or removed from the safety foothold 6 with a simple one-hand action during climbing. The safety foothold 6 comprises an open loop for receipt of the life-line.

FIG. 2 shows an embodiment of the device 2 according to the invention. The device comprises a foot-rest part 5 with anti-slip device 8 at each end, an attachment part 9 is arranged at one anti-slip device 8 of the foot-rest part 5. The safety foothold 6 is arranged between the two anti-slip devices 8 of the foot-rest part 5. The safety foothold 6 consists of a bent part, the ends of which are connected to the foot-rest part 5 so that the parts of the foot-rest 5 on each side of the bent part have coinciding central axes.

I claim:

1. A climbing device with a safety foothold comprising:

a rod, said rod having a first and a second end, a bent section therebetween adapted to receive a life-line and straight sections on both sides of said bent section, at least one straight section being adapted to define a footrest wherein said bent section is an open loop which is hook shaped, a hooked end of which bends back upon itself such that said straight sections on both sides of said bent section have coinciding central axes, said straight sections and bent section being a continuous rod of uniform cross section.

2. The device according to claim 1 further comprising a flange provided at least one end of said rod.

3. The device according to claim 1 further comprising an attachment part provided at one end of said device whereby said device may be attached to an object to be climbed.

4. The device according to claim 3 being attached at said attachment part to a power-line pylon.

* * * * *